US006110302A

United States Patent [19]

Gorman

[11] Patent Number: 6,110,302

[45] Date of Patent: Aug. 29, 2000

[54] DUAL-PROPERTY ALPHA-BETA TITANIUM ALLOY FORGINGS

[75] Inventor: Mark D. Gorman, West Chester, Ohio

[73] Assignee: General Electric Company, Cincinnati, Ohio

[21] Appl. No.: 09/045,809

[22] Filed: Mar. 23, 1998

Related U.S. Application Data

[62] Division of application No. 08/773,455, Dec. 24, 1996, Pat. No. 5,795,413.

[51] Int. Cl.[7] ..... C22F 1/18

[52] U.S. Cl. ..... 148/407; 148/671

[58] Field of Search ..... 148/407, 421, 148/670, 671

[56] References Cited

U.S. PATENT DOCUMENTS

| | | | |
|---|---|---|---|
| 3,794,528 | 2/1974 | Rosales et al. | 148/407 |
| 5,358,586 | 10/1994 | Schutz et al. | 148/421 |
| 5,447,580 | 9/1995 | Semiatin et al. | 148/421 |
| 5,795,413 | 8/1998 | Gorman | 148/671 |

OTHER PUBLICATIONS

Schuster, J., et al., Phases and Phase Relations in the Partial System $TiAl_3$–TiAl, *Z. Metallkunde,* vol. 81, No. 6, 1990, pp. 389–396, 1990.

*Primary Examiner*—George Wyszomierski
*Attorney, Agent, or Firm*—Andrew C. Hess; David L. Narciso

[57] ABSTRACT

An alpha-beta titanium alloy preform is processed in the beta phase field, by heat treating or beta forging. The processed preform is thereafter heated into the alpha-beta phase field, and a preselected portion is forged, leaving a nonselected portion that is not forged in the alpha-beta phase field. The resulting article has a beta-processed structure in the nonselected portion, and a beta-processed plus alpha-beta forged structure in the preselected portion. In one application, the preform has the shape of a disk useful in the manufacture of an aircraft gas turbine engine. Depending upon specific requirements, either the center or the rim of the disk may be the selected portion.

12 Claims, 3 Drawing Sheets

DUAL-PROPERTY ALPHA-BETA TITANIUM ALLOY FORGINGS

This is a division of patent application Ser. No. 08/773,455, field Dec. 24, 1996, now U.S. Pat. No. 5,795,413.

BACKGROUND OF THE INVENTION

This invention relates to articles made of alpha-beta titanium alloys and, more particularly, to a processing technique used to obtain optimized properties in different regions of the articles.

Properly processed titanium alloys exhibit good properties at room-to-intermediate temperatures, and are of low density as compared with steel, nickel, and cobalt alloys. Titanium alloys are used in aircraft gas turbine (jet) engines in components that are exposed to intermediate temperatures during service. For example, heat-treated and/or thermomechanically processed titanium alloys are used in rotating components such as fan disks, fan blisks, high-pressure compressor disks, and high-pressure compressor blisks that operate at temperatures as high as about 600° C. during service.

Rotating components such as disks and blisks have material performance requirements that vary according to the location on the article. A blisk is a disk with integral blades extending from the outer periphery of the disk region. The disk region may be either solid or annular with a bore therethrough. The central region of the disk requires good crack growth properties and good fracture toughness. The airfoil regions of the blades require good fatigue properties and ductility to resist foreign object damage.

Alpha-beta (including near-beta) titanium alloys are currently used in a number of disk and blisk applications. Such alloys have equilibrium phase diagrams with an equilibrium beta phase stable at temperatures above about 850–1050° C. At much lower temperatures, the alpha phase maybe thermodynamically stable, but because of kinetics considerations a mixture of alpha and beta phases is usually observed. Some alloys may exhibit nearly 100 percent alpha phase at lower temperatures, although alloy chemistry balance and kinetic considerations generally preclude this. However, the equilibrium phase diagrams provide guidelines as to the nature of the phases typically present in the alloys. The well-known Ti-6A1-4V alloy is an example of an alpha-beta titanium alloy, and the Ti-6A1-2Sn-4Zr-6Mo alloy is an example of a near-beta titanium alloy that is within the scope of the "alpha-beta" titanium alloys as used herein.

The alpha-beta titanium alloys may be thermally or thermomechanically processed to produce various types of useful properties. For example, processing in the beta phase field typically leads to an alloy with good fracture toughness, crack growth, and creep properties, but less-than-optimal fatigue properties. Similarly, processing in the alpha-plus-beta range leads to good ductility and fatigue properties but less-than-optimal fracture toughness.

Thus, the available alpha-plus-beta titanium alloys do not provide a combination of properties that is optimized for performance in both the central and blade regions of a blisk, or in the central and rim regions of a disk. There have been many attempts, with varying degrees of success, to develop improved alloys and to identify optimized heat-treatment approaches that lead to an improved combination of properties for use in such disks and blisks. However, there remains a need for an improved approach to the manufacture of titanium-alloy articles for use in applications such as the rotating components of aircraft gas turbine engines. The present invention provides such an improved approach, and further provides related advantages.

SUMMARY OF THE INVENTION

The present invention provides a processing approach for alpha-beta titanium alloys to provide improved properties for use in applications such as gas-turbine engines. The processing approach is operable with existing alphabeta titanium alloy compositions and should be operable with future compositions, as well. No alteration of the composition of the alloy is required in order to practice the invention, an important advantage because the beneficial properties of the existing alloys can be retained, but their processing for specific applications is improved. The present approach may be practiced using available equipment, but the processing steps are modified.

In accordance with the invention, a method for preparing a titanium-alloy article includes providing a preform of an alpha-beta titanium alloy. The method further includes processing the preform in the beta phase field, and thereafter forging a preselected portion of the processed preform in the alphabeta phase field to form the titanium-alloy article, so that a nonselected portion of the preform is not forged. That is, the entire preform is first beta processed, and thereafter only the preselected portion is alpha-beta forged. The betaphase processing may be without deformation, but may also include deformation, such as by forging, within the beta phase field.

As used herein, the term "alpha-beta titanium alloy" includes those alloys having more than about 70 weight percent titanium and whose equilibrium phase diagram exhibits a beta phase field and an alpha-beta phase field. This definition includes those alloys traditionally recognized as alphabeta titanium alloys, and also those alloys sometimes described as "near-beta" alloys.

The alpha-beta forging of the preselected region, following a prior beta processing of both the nonselected and the preselected regions, does not adversely alter the properties of the beta-processed nonselected region to any substantial degree, because the temperature is lower than that of the initial operation and because no additional strain is incurred to alter the microstructure of the nonselected region. The properties of the alpha-beta forged region are substantially those resulting from alpha-beta forging. A (nonselected) portion of the final article thus has the structure and properties associated with beta processing, while a different (preselected) region has the structure and properties associated with alpha-beta processing.

The present invention is not concerned with determining which region of the article is the "preselected" portion of the article and/or the choice of properties to be optimized, a task left to the designers of the articles. The present invention is instead concerned with providing the designers the capability to make such selections to achieve the best properties in the article with the assurance that their selections may be implemented using the present approach.

However, some important applications present themselves. In the case of a blisk used for many applications, the central region may be processed with beta-phase processing alone to produce good crack growth and toughness properties. The blade region may be processed first with the same beta-phase processing and thereafter with alpha-beta forging to produce good fatigue properties, without adversely affecting the properties of the central region. In a disk, on the other hand, the rim region may be processed with beta-phase processing alone to produce good creep properties, and the central region may be processed first with the same beta-phase processing and thereafter with alpha-beta forging to produce good ductility and thence burst properties, without adversely affecting the properties of the rim region.

The approach of the invention may be contrasted with other techniques which might be expected to be operable but which have important shortcomings. For example, it might be thought possible to alpha-beta forge the entire article and thereafter beta heat treat one portion only, using a differential heat treating technique. In another variation, the different portions of the article might be heated to different temperatures and thereafter forged. Such techniques are not practical for articles having a large through-thickness in some regions, such as disk or blisk preforms, because the temperatures and cooling rates cannot be controlled with sufficient accuracy throughout the thickness of the article. Beta processing, in particular, requires careful control of processing parameters, and differential-temperature processing, while possible in theory, would not be practical for many production operations. In yet another approach, a central structure and a rim structure could be separately fabricated with optimal properties and then welded or joined together. This approach would be costly and would leave questions of joint integrity in a part that rotates at high speeds.

The present invention thus provides an important advance in the art of processing alpha-beta titanium alloys for applications such as disks and blisks, as well as for other articles. Optimized properties may be achieved where they are required in different locations of the article, in a commercially practical processing operation. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment

DETAILED DESCRIPTION OF THE INVENTION

The present invention provides a method for the processing of articles made of alpha-beta titanium alloys. As used herein, the term "alpha-beta titanium alloy" includes those alloys having more than about 70 weight percent titanium and whose equilibrium phase diagram exhibits a beta phase field and an alpha-beta phase field. All compositions herein are in weight percent and are nominal compositions unless indicated to the contrary. Some examples of alpha-beta titanium alloys useful in practicing the invention, with their nominal compositions, include Ti 6-4, having a composition of Ti-6 percent Al-4 percent V; Ti-17, having a composition of Ti-5 percent Al-4 percent Cr-4 percent Mo-2 percent Zr, 2 percent Sn; Ti 6-2-4-2, having a composition of Ti-6 percent Al-2 percent Mo-4 percent Zr-2 percent Sn; Ti 6-2-4-6, having a composition of Ti-6 percent Al-6 percent Mo-4 percent Zr-2 percent Sn; IMI 829, having a composition of Ti-5.5 percent Al-3.5 percent Sn-3 percent Zr-1 percent Nb-0.25 percent Mo-0.3 percent Si; IMI 834, having a composition of Ti-5.8 percent Al-4 percent Sn, 3.5 percent Zr-0.7 percent Nb-0.5 percent Mo-0.35 percent Si-0.06 percent C; IMI 550, having a composition of Ti-4 percent Al-2 percent Sn-4 percent Mo-0.5 percent Si; Ti 8-1-1, having a composition of Ti-8 percent Al-1 percent V-1 percent Mo; Ti 10-2-3, having a composition of Ti-3 percent Al-10 percent V-2 percent Fe; and Ti-1100, having a composition of Ti-6 percent Al-2.75 percent Sn-4 percent Zr-0.4 percent Mo-0.45 percent Si. Of these alloy compositions, Ti-17 and Ti 6-2-4-6 are sometimes described as near-beta alloys, but are nevertheless included within the scope of the present invention.

Figure 1:
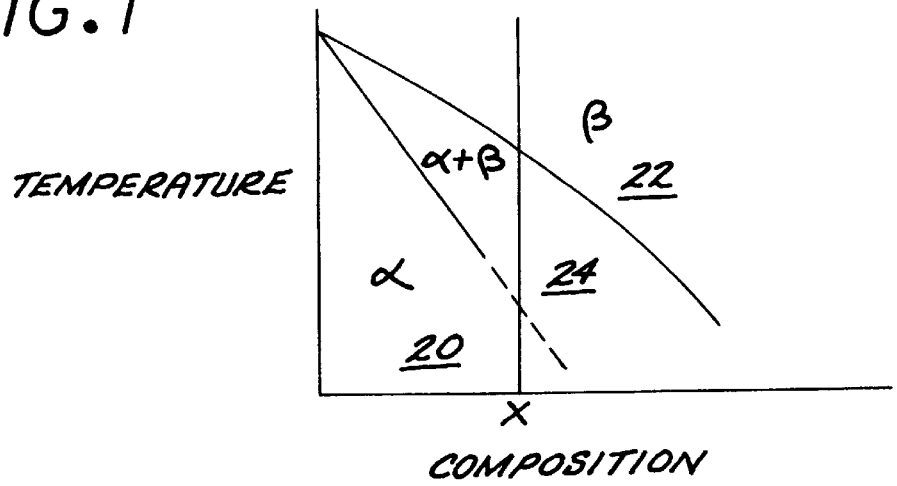
FIG. 1 is a schematic representation of the titanium-rich end of a phase diagram.

FIG. 1 is a schematic representation of the pertinent features of an equilibrium temperature-composition phase diagram for such an alpha-beta titanium alloy, represented by a vertical line at a composition X. At relatively low temperatures, the alpha ($\alpha$) phase is thermodynamically stable in an alpha phase field 20 although, as discussed previously, the condition of thermodynamic stability may not be reached at low temperatures, and instead a mixture of alpha and beta phases may be observed. At relatively high temperatures, the beta ($\beta$) phase is stable in a beta phase field 22. At intermediate temperatures, a mixture of the alpha and beta phases is stable in an alpha-plus-beta phase field 24. This identification of phase fields, rather than specific temperatures and compositions, provides the most unambiguous manner of specifying the condition of the processing of the alloy, inasmuch as the specific values of the temperatures and compositions of the phase diagram of FIG. 1 vary according to the composition of the alloy. Further, it will be appreciated that the phase diagram represents equilibrium conditions, and the lower temperature pure-alpha phase field is seldom achieved because of the complexity of the alloys and the slower kinetics experienced at lower temperatures. Nevertheless, the equilibrium phase diagram provides a useful tool for defining the alloys and analyzing phase states and reactions in such alloys.

The practice of the invention in relation to two preferred embodiments, a blisk and a disk, will be described to illustrate the flexibility inherent in the present approach.

Figure 2:
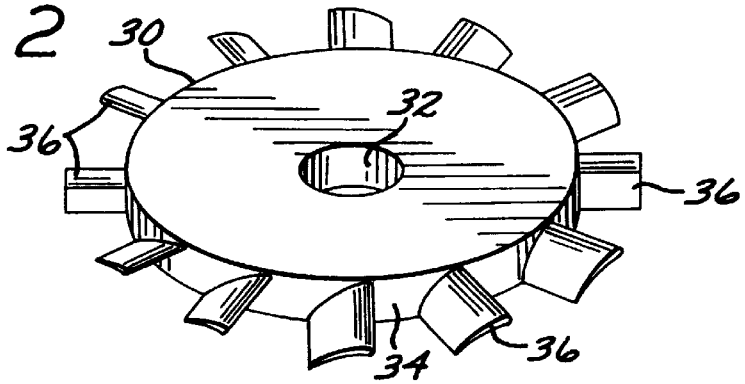
FIG. 2 is a perspective view of a finished blisk.

A finished blisk 30 is illustrated in FIG. 2. The finished blisk 30 is generally in the form of an annular, flat, thick washer (i.e., a short, thick-walled, hollow cylinder). The illustrated blisk 30 is an annular flat washer having an inner periphery 32 and an outer periphery 34, although the disk could instead be solid with no bore therethrough and thence no inner periphery. A series of integral blades or airfoils 36 extend radially outwardly from the outer periphery 34 around its circumference. (In all of the illustrations of blisks and disks herein, the number of blades illustrated is much smaller than in an actual article, for clarity.)

Figure 3:
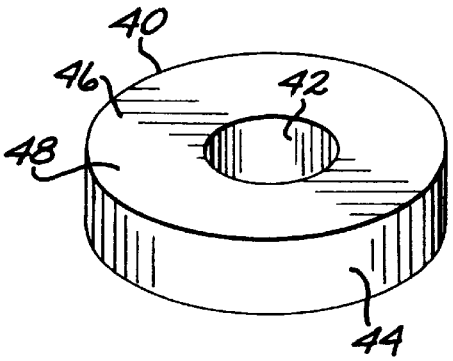
FIG. 3 is a perspective view of a blisk preform.
Figure 4:
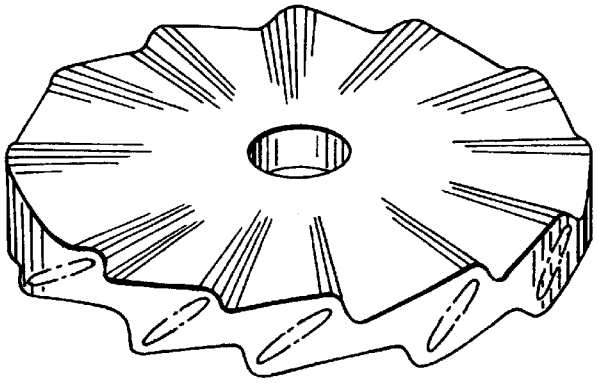
FIG. 4 is a perspective view of a blisk preform after scallop forging.

A preferred approach to fabricating the blisk 30 is to start with a blisk preform 40, illustrated in FIG. 3. The preform may be solid or annular, here illustrated as annular, but thicker and with a larger-diameter inner periphery 42 and a smaller-diameter outer periphery 44. The portion near the inner periphery 42 is termed the central region 46, and the portion near the outer periphery 44 is termed the blade region 48. The preform 40 is thermomechanically processed to reduce its thickness, and alter the inner and outer peripheries. In some cases, the forging is performed to create a scalloped structure that increases the strain in the blade region 48 and reduces the amount of subsequent machining required, as shown in FIG. 4. The processed preform 40 is thereafter machined to form the blades 36 integrally with the outer periphery of the final blisk. Thus, the material that is initially near the outer periphery 44 of the preform, the blade region 48, is ultimately machined to form the blades 36. After the thermomechanical processing is complete, but before machining of the blades, the properties of the blade region 48 must be those which are acceptable for the final blades 36.

Figure 5:
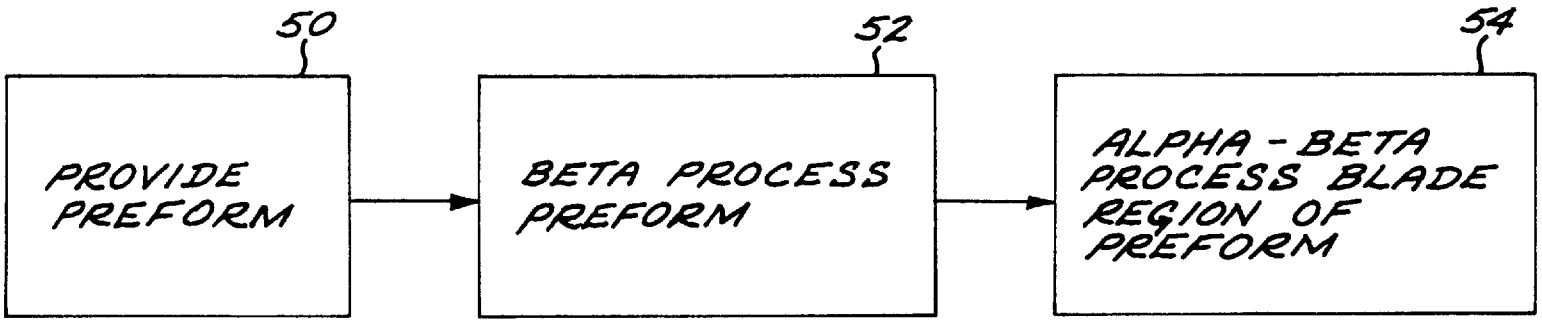
FIG. 5 is a block diagram depicting the processing of a blisk preform according to the invention.

FIG. 5 depicts a method for producing the blisk 30 from the blisk preform 40, according to the invention. The blisk preform 40 is provided, numeral 50. The preform is made of an alpha-beta titanium alloy such as described in relation to FIG. 1. Any operable alpha-beta titanium alloy may be used. The blisk preform 40 has an annular washer shape as shown in FIG. 3 (or the scalloped annular shape of FIG. 4) after the deformations to be discussed herein have been applied, from which the final blisk 30 of FIG. 2 is machined.

The entire blisk preform 40 is beta processed, numeral 52. The beta processing is accomplished either without or with associated deformation. A preferred beta processing without deformation includes heating the entire blisk preform to a beta-treating temperature of from about 10 to about 150° C. above the phase boundary between the beta phase field 22 and the alpha-plus-beta phase field 24, for a time sufficient to achieve a beta solid solution, typically about 1 hour or more. In the case of one of the alloys of most interest, the Ti-17 alloy, the beta processing without deformation is accomplished by heating to a temperature of about 925° C. for a time of about 1 hour. After this beta heat treatment is complete, the preform is cooled to a temperature in the alpha phase field 20 or in the alpha-beta phase field 24 at a rate sufficiently high to minimize formation of grain-boundary alpha phase. For the case of beta processing with deformation, the same procedure is followed, but the preform is deformed, preferably by forging with relatively large strain, while it is at the beta-treating temperature. The beta deformation, where used, is typically to a strain of at least about 0.2, but may be much larger. A strain of at least 0.5 is preferred.

After the beta processing 52 is complete, a preselected portion of the as-beta-processed preform is alpha-beta processed, numeral 54, preferably by forging. The alpha-beta forging 54 must sequentially follow the beta processing 52. The order of the two processing steps 52 and 54 may not be reversed and still produce the desirable final results achieved by the present approach.

In the case of the blisk preform 40 and blisk 30, the "preselected portion" for alpha-beta forging is the blade region 48. The entire as-betatreated blisk preform is heated to an alpha-plus-beta forging temperature within the alpha-plus-beta phase field 24. In the case of the preferred Ti-17 alloy, the alpha-plus-beta forging temperature is from about 815 to about 885° C. The blisk preform 40 is then forged by applying a load parallel to the annular axis of the preform that causes a displacement perpendicular to the annular axis of the preform. The strain of the preform during the alpha-beta forging is at least about 0.2, with even greater strains preferred. A strain of at least 0.5 is preferable.

This alpha-beta forging is not applied uniformly across the entire blisk preform 40, but instead is applied only in the preselected portion, which in this case is the blade region 48. If the central region 46 and the blade region 48 were initially of the same thickness, after the alpha-plus-beta forging is complete the blade region 48 is thinner than the central region 46. On the other hand, the preform 40 may be designed so that the blade region 48 is initially thicker than the central region 46, so that, after the alpha-plus-beta forging is complete, the two regions 46 and 48 have substantially the same thickness. After the forging is complete at the alpha-plus-beta forging temperature, the article is cooled into the alpha-phase field 20, and typically to room temperature. The alpha-beta forging may be the previously discussed scallop forging.

Figure 7:
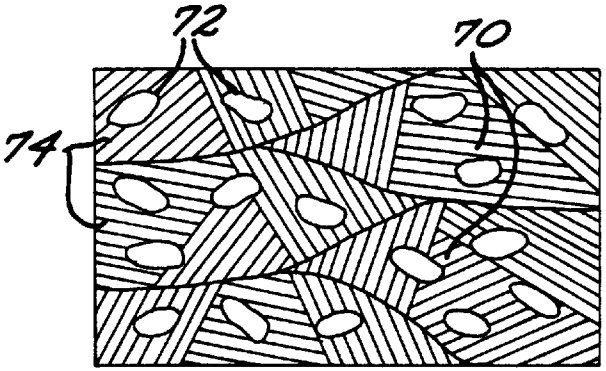
FIG. 7 is a schematic depiction of the microstructure of the blade region of the blisk, prior to machining the blades.
Figure 6:
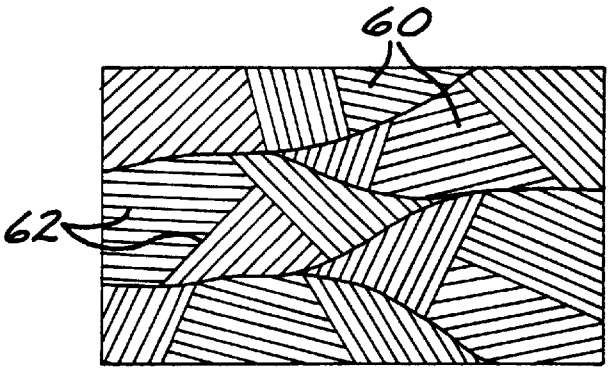
FIG. 6 is a schematic depiction of the microstructure of the central region of the blisk.

FIGS. 6 and 7 illustrate the resulting microstructures in the central region 46 and the blade region 48, respectively. The central region 46, as shown in FIG. 6, has a structure of retained beta grains 60, which may be substantially equiaxed if the beta processing is without deformation or, as shown, elongated if the beta processing is with deformation. Within the beta grains, there is a pattern of needle-like alpha precipitates 62 produced during cooling. This microstructure of FIG. 6 in alpha-plus-beta titanium alloys is generally associated with good toughness, good resistance to crack growth, and good creep performance, but relatively poorer fatigue life and poorer ductility. However, the central region 46 requires good toughness and resistance to crack growth, and therefore the microstructure of FIG. 6 produces excellent results in the central region 46.

The microstructure of the blade region 48 is shown in FIG. 7. Beta grains 70 contain a dispersion of rodlike or spherical alpha-phase precipitates 72 that were produced during the forging and spheroidizing period in the alpha-plus-beta phase field 24. These alpha-phase precipitates 72 require straining to form, and therefore they form only in the preselected region being alpha-beta forged and not in the region which is not alpha-beta forged (that is, the precipitates 72 are not found in the microstructure of FIG. 6). Between these precipitates 72 there is a pattern of needle-like alpha-phase precipitates 74 that are produced during cooling from the alpha-beta temperature, as well as some retained beta phase. This microstructure of FIG. 7 in alpha-plus-beta titanium alloys is generally associated with good fatigue resistance and good ductility, but relatively poorer toughness, crack growth resistance, and creep. The blades which are thereafter machined into the blade region 46 require good fatigue resistance and ductility to resist foreign object impact damage, and therefore the microstructure of FIG. 7 produces excellent results in the blades 36, after they are machined from the blade region 48.

After the processing 54 is complete, the article is optionally further processed. In this case of the blisk, the blades are machined and the surfaces of the central region are machined as necessary. Other heat treatments, surface treatments such as shot peening, inspections, and other procedures may be followed.

The preceding discussion has set forth a procedure for attaining particular structure and properties in a blisk The procedure may be applied to other articles as well.

Figure 9:
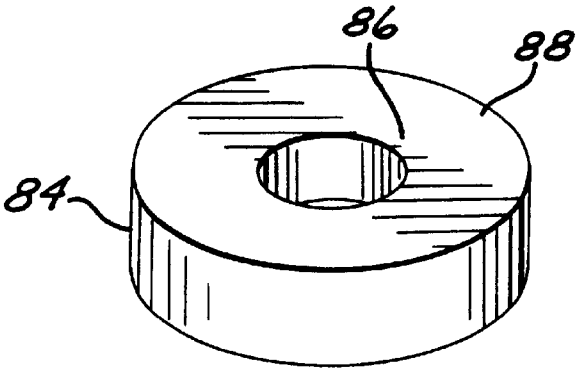
FIG. 9 is a perspective view of a disk preform.
Figure 8:
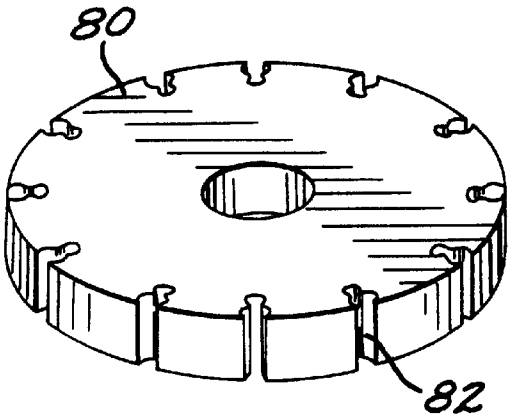
FIG. 8 is a perspective view of a finished disk.
Figure 10:
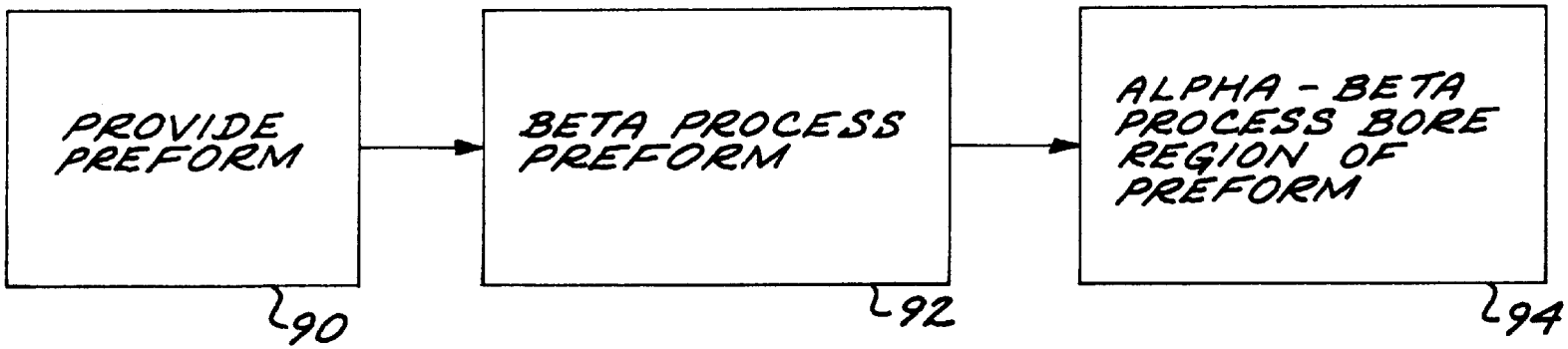
FIG. 10 is a block diagram depicting the processing of a disk preform according to the invention.

FIGS. 8–10 depict another application of the present invention, which is similar yet distinct. FIG. 8 illustrates a finished compressor disk 80 which has dovetail slots 82 on its outer periphery into which compressor blades are set. FIG. 9 shows an annular disk preform 84 having a central region 86 and a rim region 88. This preform is similar to the blisk preform 40, but after processing the rim region 88 is not machined into blades, and instead must bear the loads imposed at the dovetail slots 82 by the turbine blades that are inserted into the slots 82.

FIG. 10 depicts the steps used to prepare the compressor disk 80 from the preform 84. The preform is provided, numeral 90, and beta processed, numeral 92. These steps are identical to respective steps 50 and 52 of FIG. 5, and the description of those steps is incorporated here. The disk preform 84 is thereafter alpha-beta processed, numeral 94. This step is identical to step 54 of FIG. 5, and the description of this step is incorporated here, except that the preselected portion to which the alpha-beta forging is applied is the central region 86 of the disk preform 84 (as distinct from the blade region 48 of the blisk preform 40 in the processing of FIG. 5). The final result is that the central region 86 has the type of microstructure illustrated in FIG. 7, and the rim region 88 has the type of microstructure illustrated in FIG. 6. The rim region 88 therefore has excellent creep performance, as required in the neighborhood of the slots 82, and good ductility and thence burst performance in the central region 86.

This approach may be applied to other articles as well as the compressor disk 80. For example, it may be applied to a blisk in the case where the creep properties of the airfoil are of greater interest than its fatigue and ductility properties.

The structures discussed herein are presented by way of example, and are not limiting of the application of the present invention. Particular alloys and associated microstructures are selected for particular aircraft engine applications by the designers of the engine, and such selections are not within the scope of the present invention. Instead, the present approach provides the means by which particular structures may be fabricated, once they have been specified by the designers. Stated alternatively, the "selection" and "preselection" and "nonselection" of regions of the article for processing (or not processing) are made by those who design the engine in order to achieve particular properties, and are provided as input information to those who practice the present invention.

This invention has been described in connection with specific embodiments and examples. However, those skilled in the art will recognize various modifications and variations of which the present invention is capable without departing from its scope as represented by the appended claims.

What is claimed is:

1. An article comprising an alpha-beta titanium alloy whose phase diagram exhibits a beta phase field and an alpha-beta phase field, the article having a first portion with a beta-processed microstructure and a second portion with a beta-processed plus alpha-beta forged microstructure, wherein the first portion has a microstructure comprising needle-like alpha phase precipitated in beta grains, and the second portion has a microstructure comprising rod-like or spherical alpha phase precipitates in a matrix comprising needlelike alpha phase precipitated in beta grains.

2. The article of clam 1, where the alpha-beta titanium alloy has a nominal composition, in weight percent, selected from the group consisting of Ti 6-4, having a composition of Ti-6 percent Al-4 percent V; Ti-17, having a nominal composition of Ti-5 percent Al-4 percent Cr-4 percent Mo-2 percent Zr, 2 percent Sn; Ti 6-2-4-2, having a nominal composition of Ti-6 percent Al-2 percent Mo-4 percent Zr-2 percent Sn; Ti 6-2-4-6, having a nominal composition of Ti-6 percent Al-6 percent Mo-4 percent Zr-2 percent Sn; IMI 829, having a nominal composition of Ti-5.5 percent Al-3.5 percent Sn-3 percent Zr-1 percent Nb-0.25 percent Mo-0.3 percent Si; IMI 834, having a nominal composition of Ti-5.8 percent Al-4 percent Sn, 3.5 percent Zr-0.7 percent Nb-0.5 percent Mo-0.35 percent Si-0.06 percent C; IMI 550, having a nominal composition of Ti-4 percent Al-2 percent Sn-4 percent Mo-0.5 percent Si; Ti 8-1-1, having a nominal composition of Ti-8 percent Al-1 percent V-1 percent Mo; Ti 10-2-3, having a nominal composition of Ti-3 percent Al-10 percent V-2 percent Fe; and Ti-1100, having a nominal composition of Ti-6 percent Al-2.75 percent Sn-4 percent Zr-0.4 percent Mo-0.45 percent Si.

3. The article of claim 1, wherein the article has the shape of a disk.

4. The article of claim 3, wherein the first portion is located adjacent to a center of the disk and the second portion is located adjacent to an outer periphery of the disk.

5. The article of claim 3, wherein the first portion is located adjacent to an outer periphery of the disk and the second portion is located adjacent to a center of the disk.

6. The article of claim 1, wherein the first portion and the second portion are of the same chemical composition.

7. The article of claim 1, wherein the first portion has a microstructure of beta grains with a pattern of needle-like alpha precipitates therein produced during cooling.

8. The article of claim 1, wherein the second portion has a microstructure of beta grains containing a dispersion of rodlike or spherical alpha-phase precipitates that were produced during a forging period in the alpha-plus-beta phase field, with a pattern of needle-like alpha-phase precipitates between the rodlike or spherical alpha-phase precipitates that are produced during cooling from the alpha-beta temperature, and retained beta phase.

9. The article of claim 1, wherein the article has the shape of a blisk formed having integral blades extending from an outer periphery of a disk, and wherein the first region comprises the disk and the second region comprises the blades.

10. An article comprising an alpha-beta titanium alloy whose phase diagram exhibits a beta phase field and an alpha-beta phase field, the article having a first portion processed with a first processing procedure and a second portion processed with a second processing procedure, wherein the first portion has a microstructure comprising needle-like alpha phase precipitated in beta grains, and the second portion has a microstructure comprising rod-like or spherical alpha phase precipitates in a matrix comprising needlelike alpha phase precipitated in beta grains.

11. The article of claim 10, wherein the article is a disk, and wherein the first portion is located adjacent to a center of the disk and the second portion is located adjacent to an outer periphery of the disk.

12. The article of claim 10, wherein the article has the shape of a blisk formed having integral blades extending from an outer periphery of a disk, and wherein the first region comprises the disk and the second region comprises the blades.

* * * * *